US010066917B1

(12) United States Patent
Youn et al.

(10) Patent No.: US 10,066,917 B1
(45) Date of Patent: Sep. 4, 2018

(54) LIFTING PLUG HAVING IMPROVED INSENSITIVE PERFORMANCE FOR HIGH EXPLOSIVE PROJECTILE

(71) Applicants: SOOA Corporation, Daejeon (KR); Yea Min Youn, Daejeon (KR); Seon Tae Jung, Chungcheongbuk-do (KR)

(72) Inventors: Yea Min Youn, Daejeon (KR); Seon Tae Jung, Cheongju (KR)

(73) Assignees: SOOA Corporation, Daejeon (KR); Yea Min Youn, Daejeon (KR); Seon Tae Jung, Cheongju (KR)

( * ) Notice: Subject to any disclaimer, the term of this patent is extended or adjusted under 35 U.S.C. 154(b) by 0 days.

(21) Appl. No.: 15/844,023

(22) Filed: Dec. 15, 2017

(30) Foreign Application Priority Data

Jun. 14, 2017 (KR) ..... 10-2017-0074970

(51) Int. Cl.
*F42B 39/20* (2006.01)

(52) U.S. Cl.
CPC ..... *F42B 39/20* (2013.01)

(58) Field of Classification Search
CPC ..... F42B 39/20; F42C 19/04
See application file for complete search history.

(56) References Cited

U.S. PATENT DOCUMENTS 3,173,364 A * 3/1965 Nordzell ..... F42B 3/00 102/200
3,665,857 A * 5/1972 Radnich ..... F42B 39/00 102/481
3,927,791 A * 12/1975 Hershberger ..... F22B 37/46 102/481
4,205,608 A * 6/1980 Nicolaides ..... F42C 19/04 102/200
4,557,198 A * 12/1985 Hickey ..... F42B 39/20 102/481
4,727,812 A * 3/1988 Fischer ..... F42B 12/62 102/293
7,174,834 B2 * 2/2007 Dion ..... F42B 30/08 102/481
7,451,703 B1 * 11/2008 Dabiri ..... F42B 39/20 102/200
8,596,291 B2 * 12/2013 Kotefski ..... F42B 39/14 102/481
9,631,911 B2 * 4/2017 Jung ..... F42B 39/20

* cited by examiner

*Primary Examiner* — Stephen Johnson
*Assistant Examiner* — Joshua T Semick
(74) *Attorney, Agent, or Firm* — Lewis Roca Rothgerber Christie LLP

(57) ABSTRACT

The present invention relates to a lifting plug having improved insensitive performance for a high explosive projectile, in which the lifting plug ensures long-term storage such as a prevention of maximum moisture absorption during storage of high explosives and has improved airtightness by attaching an auxiliary bolt and an O-ring in addition to a lock bolt to a window of the lifting plug. Furthermore, the lifting plug prevents rupturing or cracking of the lifting plug by changing a material and thickness of the lifting plug and is provided with a vent formed by an ignition of explosives igniting at lower temperature compared with a main charge and a supplementary charge, thereby improving a safety of the long-term storage, as well as improving insensitivity.

8 Claims, 4 Drawing Sheets

LIFTING PLUG HAVING IMPROVED INSENSITIVE PERFORMANCE FOR HIGH EXPLOSIVE PROJECTILE

CROSS REFERENCE TO RELATED APPLICATION

The present application claims priority to Korean Patent Application No. 10-2017-0074970, filed Jun. 14, 2017, the entire contents of which is incorporated herein for all purposes by this reference.

BACKGROUND OF THE INVENTION

Field of the Invention

The present invention generally relates to a lifting plug having improved insensitive performance for a high explosive projectile. More particularly, the present invention relates to a lifting plug having improved insensitive performance for a high explosive projectile, in which the lifting plug has improved airtightness and storage safety during long-term storage of projectiles by attaching an auxiliary bolt and an O-ring in addition to a lock bolt to a window of the lifting plug, and prevents the lifting plug rupturing or cracking when a material is changed or a thickness thereof is increased, thereby improving safety of the high explosive projectile as well as improving insensitivity, for a preparation of unexpected accidents such as fires or terrorism during storage of high explosive projectiles.

Description of the Related Art

Generally, a large size high explosive projectile such as a 155 mm artillery projectile is carried or stored after a lifting plug is mounted to the artillery projectile for safety purposes, but when unexpected accidents such as fires or terrorism occur, detonation or an explosion of the artillery projectile may occur due to heat accumulated in the artillery projectile, thereby causing considerable damage to human lives and property.

To prevent the explosion and the detonation of the stored large size high explosive projectile, insensitive explosives such as a plastic bonded explosive (PBX) have been developed as a substitute for trinitrotoluene (TNT) and composition B (Comp-B), which are conventional high explosives, but the PBX is expensive, and thus is limited to applications in missile warheads.

Meanwhile, referring to a related art concerning a safety device of a high explosive projectile presented in the following patent document 1 applied and registered by the applicant of the present invention, there is presented a lifting plug for a high explosive projectile capable of forming a vent in the case of ignition of the explosives. As shown in FIG. 1, the lifting plug of patent document 1 is mounted to a front part of a shell 9 of the projectile by being screwed thereto with a fuse being removed from the front part. The lifting plug of patent document 1 includes: a plug body 1; a handle 2 provided on the plug body 1; a window 3 combined with the plug body 1 by a bolt 4 fastened to respective locking holes 5 and 5' of the plug body 1; and explosives 7 charged under the bolt 4 such that when the explosives 7 ignite, the window 3 is removed from the plug body 1 by explosive power generated by the ignition of the explosives, thereby forming a vent 6 in the lifting plug and preventing ignition of a supplementary charge 8 and a main charge 10 of the projectile, and thus preventing an explosion of the projectile.

However, according to the related art, the lifting plug has only one bolt 4 for locking, thus it has week airtightness when the window and the plug body combined, and rupturing or cracking may occur in the handle due to a material and a thickness of the handle of the lifting plug.

Accordingly, it is urgent to develop a device for an artillery projectile by improving airtightness of the lifting plug when transporting the high explosive projectile and changing the material and the thickness of the handle of the lifting plug, thereby improving the insensitivity of the lifting plug.

DOCUMENTS OF RELATED ART (Patent Document 1) Korean Patent No. 10-1700037, entitled "Lifting plug for high explosive projectile capable of forming vent by ignition of explosives" (registered on Jan. 19, 2017)

SUMMARY OF THE INVENTION

Accordingly, the present invention has been made keeping in mind the above problems occurring in the related art, and the present invention is intended to propose a lifting plug having improved insensitive performance for a high explosive projectile, wherein the lifting plug has improved airtightness and insensitivity by preventing a burst and a crack.

In order to achieve the above object, according to one aspect of the present invention, there is provided a lifting plug having improved insensitive performance for a high explosive projectile, the lifting plug being mounted to a front part of a shell of the projectile by being screwed thereto with a fuse being removed from the front part, the lifting plug including: a plug body; a handle provided on the plug body; a window combined with the plug body by a lock bolt and an auxiliary bolt fastened to respective locking holes and provided with an O-ring mounted under the window such that the O-ring realizes improved airtightness when combining the window with the plug body; and explosives charged under the lock bolt such that when the explosives ignite, the window is removed from the plug body by explosive power generated by an ignition of the explosives, thereby forming a vent in the lifting plug, keeping combustion of a main charge and a supplementary charge even in case when ignition thereof occurs, and thus preventing an explosion of the projectile.

Meanwhile, other means to achieve the object according to the present invention are described in the detailed description of the invention.

The lifting plug having improved insensitive performance for the high explosive projectile according to the present invention has the following effects.

1) Since the two bolts fastened to the window of the lifting plug are disposed at opposite sides and the O-ring is mounted under the window, the lifting plug has improved airtightness during an explosion of the explosives, thereby ensuring a long-term storage of the projectile.

2) Since the material of the lifting plug handle is composed of a thick ductile aluminum alloy, rupturing and cracking are prevented, thereby ensuring safety during handling the projectile.

3) The lifting plug is provided with the vent therein in such a manner that the window is removed from the plug body by explosive power generated in the lifting plug by an ignition of explosives igniting at lower temperatures compared with a main charge and a supplementary charge, thereby preventing an explosion of the projectile, keeping combustion of the explosives, and improving a safety of storing the high explosive projectile.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
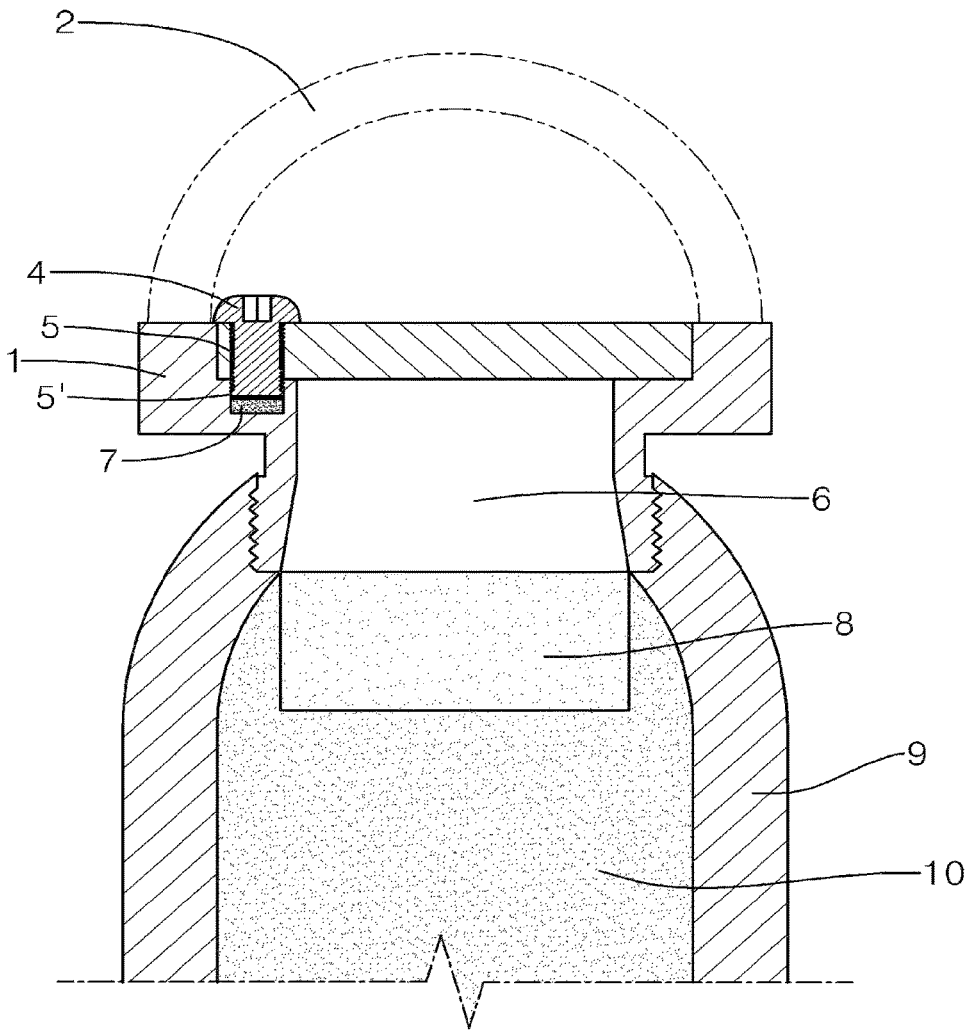
FIG. 1 is a diagram of a lifting plug for a high explosive projectile according to a related art that is connected to a shell.

Hereinbelow, an exemplary embodiment of the present invention will be described in detail with reference to the accompanying drawings. It should be understood that the embodiment of the present invention may be changed to a variety of embodiments and the scope and spirit of the present invention are not limited to the embodiment described hereinbelow. The embodiment of the present invention described hereinbelow is provided for allowing those skilled in the art to more clearly comprehend the present invention. Therefore, it should be understood that the shape of the elements and the detailed structure shown in the drawings may be simplified for clarity of illustration. The terminology used herein is for the purpose of describing embodiment of the present invention only and is not intended to be limiting.

A lifting plug having improved insensitive performance for a high explosive projectile according to the present invention will be described in detail below, reference with FIGS. 2 to 4.

The lifting plug having improved insensitive performance for a high explosive projectile of the present invention is mounted to a front part of a shell of the projectile by being screwed thereto with a fuse being removed from the front part, and includes: a plug body; a handle provided on the plug body; a window combined with the plug body by a lock bolt and an auxiliary bolt fastened to respective locking holes and provided with an O-ring mounted under the window such that the O-ring realizes improved airtightness when combining the window with the plug body; and explosives charged under the lock bolt such that when the explosives ignite, the window can be removed from the plug body by explosive power generated by an ignition of the explosives, thereby forming a vent in the lifting plug, keeping combustion of a main charge and a supplementary charge even in the case when ignition thereof occur, and thus preventing an explosion of the projectile.

A large size high explosive projectile such as a 155 mm artillery projectile is carried or stored after a lifting plug is mounted to a front part of the artillery projectile with a fuse being removed from the front part, but when unexpected accidents such as fires or terrorism occur, a detonation or an explosion of the artillery projectile may occur due to heat accumulated in the artillery projectile, thereby damaging human lives and property considerably.

The lifting plug of the present invention is easily mounted to the front part of the shell 9 of the projectile by being screwed thereto with the fuse being removed from the front part such that even in the case that the main charge ignites by heat accumulated in the projectile, the lifting plug prevents the explosion of the projectile but only keeps combustion when unexpected accidents such as fires or terrorism occur during storage of the projectile, thereby improving safety of the projectile.

Figure 2:
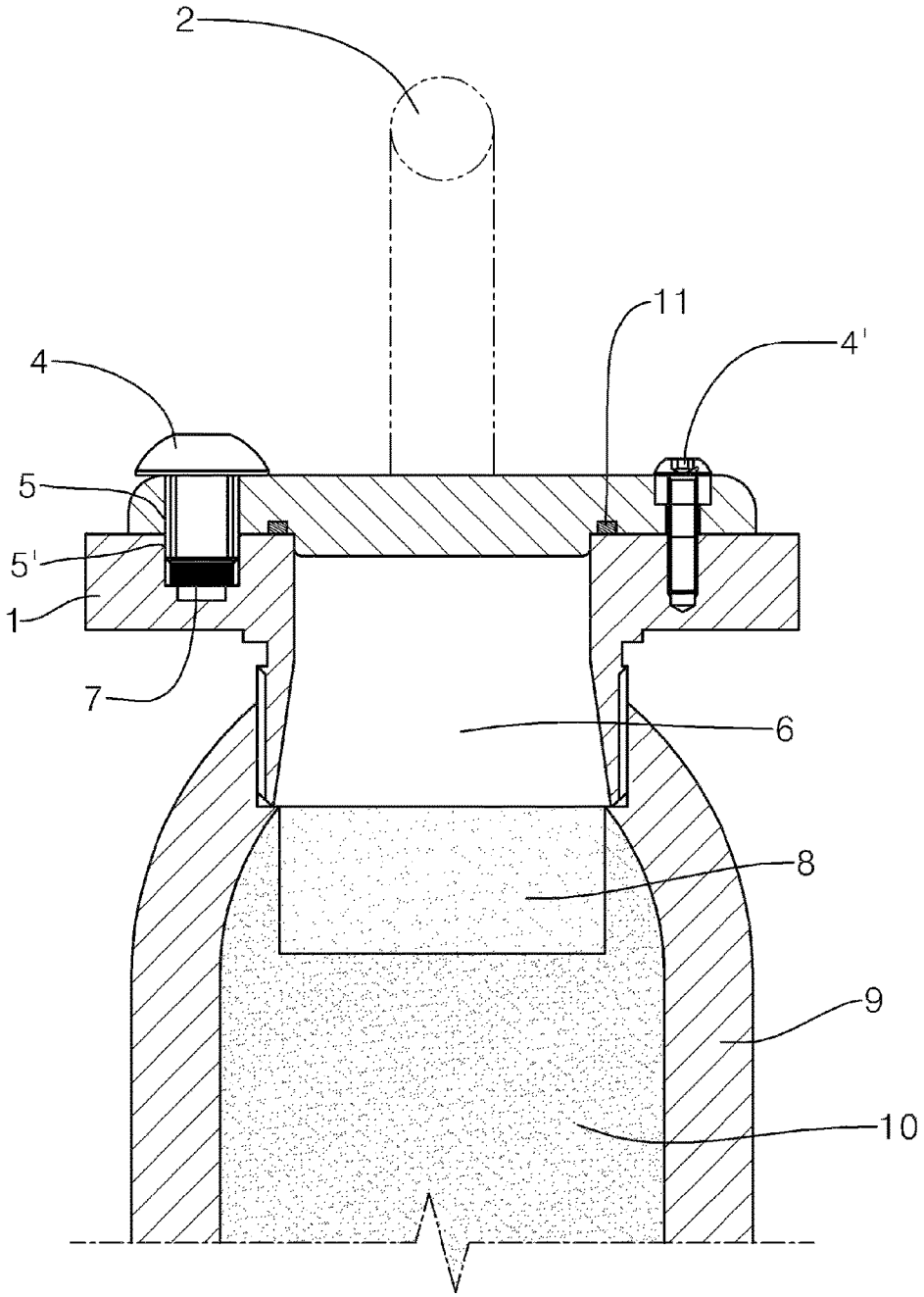
FIG. 2 is a diagram of a lifting plug having improved insensitive performance according to the present invention that is connected to a shell.
Figure 3:
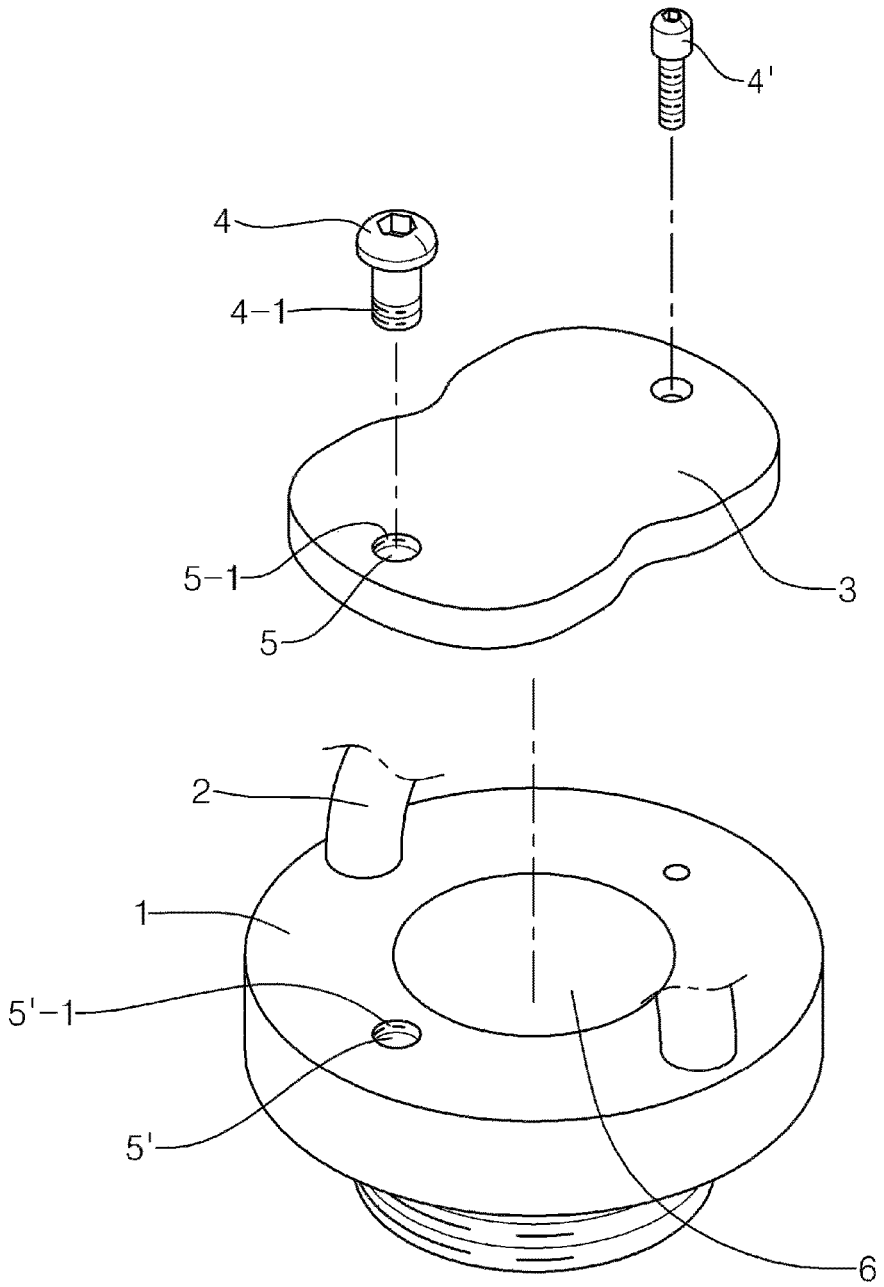
FIG. 3 is an exploded perspective view of the lifting plug having improved insensitive performance according to the present invention.

As shown in FIGS. 2 and 3, the lifting plug according to the present invention includes three components: the plug body 1, the handle 2, and the window 3. The plug body 1 is combined with a window 3 by a lock bolt 4 and an auxiliary bolt 4' fastened to locking holes 5 and 5', respectively.

However, a conventional lifting plug is composed of ALDC12, which is an Al—Si—Cu-based aluminum alloy for die casting which has a tendency to crack when used for the lifting plug. The composition of ALDC12 is 1.5% to 3.5% of Cu, 9.6% to 12.0% of Si, 0.6% to 1.0% of Fe, 0.5% or less of Mn, 0.3% or less of Mg, 1.0% or less of Zn, 0.5% or less of Ni, and a remainder of Al.

In the present invention, it was found in a study that Al6061 is preferable to use for a new material of the lifting plug. A composition of the Al6061 is 0.15% to 0.4% of Cu, 0.4% to 0.8% of Si, 0.7% of Fe, 0.15% of Mn, 0.8% to 1.2% of Mg, 0.25% of Zn, 0.04% to 0.35% of Cr, 0.15% of Ti, and a remainder of Al.

In addition, the O-ring 11 mounted under the window 3 realizes improved airtightness when combining the plug body 1 with the window 3.

Figure 4:
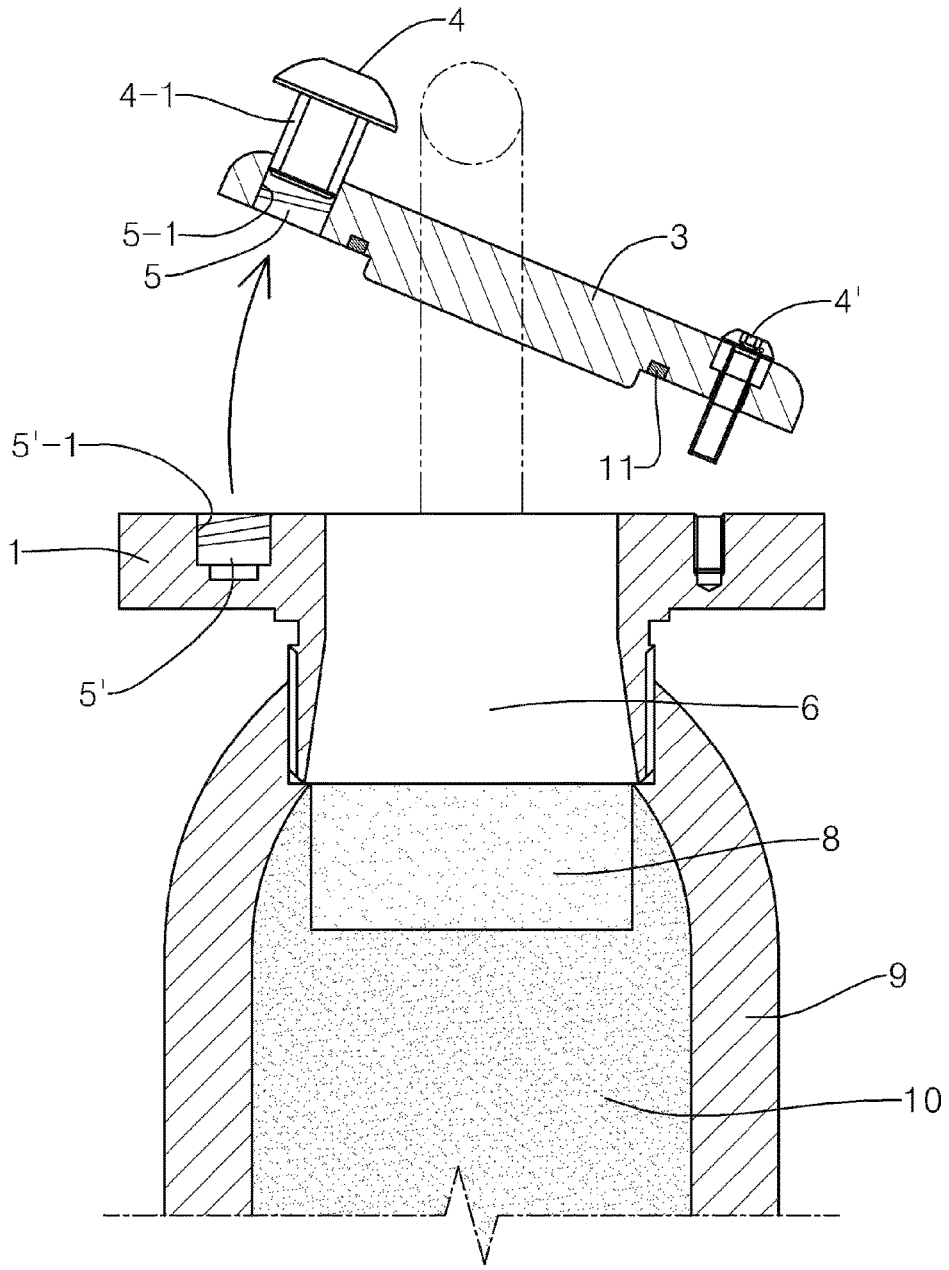
FIG. 4 is a diagram showing the operation of the lifting plug having improved insensitive performance according to present invention wherein a window of the lifting plug is separated from a plug body due to shock.

Furthermore, as shown in FIG. 2, the explosives 7 are charged under the lock bolt 4 and as shown in FIG. 4, when the explosives 7 ignite, the window 3 is removed from the plug body 1 to outside of the handle 2 by explosive power generated due to the ignition of the explosives 7, thereby forming the vent 6 in the lifting plug and keeping combustion of the supplementary charge 8 and the main charge 10 in the projectile even in the case when the ignition thereof occurs, and thus the explosion of the projectile can be prevented.

Preferably, the window 3 is combined with the plug body 1 by the lock bolt 4 and the auxiliary bolt 4' such that the window 3 mounted to the center of the plug body 1 may be easily removed from the plug body 1 to outside of the handle 2 by a strong pressure generated by the explosives 7 igniting and combusting at a temperature raging from 150° C. and 160° C. when unexpected accidents such as fires or terrorism occur during the storage of the projectile.

The explosives 7 are same with the one using in Korean Patent No. 10-1654436, entitled "Device for securing emergency exit with explosives" (registered on Aug. 30, 2016) applied and registered by an applicant of the present invention. Preferably, the explosives 7 include 20 to 50 parts by weight of N-guanylurea dinitramide (GUDN), 30 to 60 parts by weight of 3-nitro-1,2,4-triazole-5-one (NTO), 10 to 20 parts by weight of potassium nitrate ($KNO_3$), 1 to 5 parts by weight of boron, and 0.5 to 1 parts by weight of diphenylamine (DPA), and the explosives 7 have a weight ranging from 0.09 g and 0.18 g, which is small amount, and are pellet-shaped. When the explosives weigh less than 0.09 g, the lifting plug is not detached due to a weak propulsive force, whereas when the explosives weigh in excess of 0.18 g, the bolts may be separated from the window due to too strong propulsive force so cracking may occur on the handle.

The roles of the components constituting the explosives 7 will be described below. GUDN is a chemical material having a low sensitivity and high performance, and used as insensitive explosives. NTO is insensitive to heat and shock compared with conventional fillers, soluble in water, alcohol, and other solvents well so it is easy to transform crystal habits such as a crystal shape by crystallization, and used as insensitive explosives. $KNO_3$ functions as an oxidizing agent supplying oxygen required during explosion of the explosives, boron is used as a supplementary energy source, and DPA functions as a stabilizer.

When heat is accumulated in the high explosive projectile due to fires, etc, the explosives 7 charged in the lifting plug ignite before the main charge 10 and the supplementary charge 8 ignite since an ignition temperature of the explosives 7 ranges from 150° C. to 160° C., and is lower than ignition temperatures of the main charge 10 and the supplementary charge 8 charged in the high explosive projectile, which are trinitrotoluene (TNT) igniting at 295° C. As shown in FIG. 4, the window 3 is removed from the center of the plug body 1 to outside of the handle 2 with the lock bolt 4 and the auxiliary bolt 4' by the strong pressure generated during the ignition of the explosives 7 while the lock bolt 4 and the auxiliary bolt 4' restrain the window 3 from detaching strongly, thereby ensuring safety.

Accordingly, since the vent 6 is formed on an upper part of the projectile and even in the case when the main charge 10 and the supplementary charge 8 ignite, risk factors that may occur during the storage of the projectile can be removed, thereby the projectile is able to combust without detonating or exploding.

In addition, the handle 2 preferably has a thickness of 14 mm to 18 mm. When the thickness thereof is less than 14 mm, the handle may be broken due to small shocks and short drops, and when the thickness thereof exceeds 18 mm, it is inconvenient to handle the projectile.

Hereinbelow, the lifting plug for high explosive projectile having the improved insensitive performance was tested according to examples described below to verify various performances.

<Test Example>

1. Airtightness Test

An air pressure of 1.1 kg/cm$^2$ was applied to an inner space of the lifting plug for the high explosive projectile to verify whether the air pressure is able to be maintained for equal to or more than 60 seconds. As a result, a pressure gauge inside the lifting plug was maintained.

2. Load Test

For a load test, 3630±20 kgf was loaded starting from 0 kgf to each lifting plug having a different thickness. A handle having a thickness of 12 mm was cracked at 900 kgf, but a handle having a thickness of 14 mm endured until 4000 kgf was loaded and a handle having a thickness of 18 mm endured until 5200 kgf was loaded. (applying MIL-P-50875B)

3. Ductility Test

The lifting plug for the high explosive projectile was stored at −40° C. for 30 minutes and was pressurized until an inside diameter of the lifting plug was decreased by 1.27 mm and increased by 1.27 mm to verify whether the lifting plug cracked. (applying MIL-P-50875B)

As a result, the lifting plug for the high explosive projectile according to the present invention exhibited improved airtightness during storage and since the lifting plug handle was composed of a thick ductile material rupturing or cracking thereof was prevented thus ensuring safety.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A lifting plug having improved insensitive performance for a high explosive projectile, the lifting plug being mounted to a front part of a shell of the projectile by being screwed thereto with a fuse being removed from the front part, the lifting plug comprising:

a plug body;

a handle provided on the plug body;

a window combined with the plug body by a lock bolt and an auxiliary bolt fastened to respective locking holes and provided with an O-ring mounted under the window such that the O-ring realizes improved airtightness when combining the window with the plug body; and explosives charged under the lock bolt such that when the explosives ignite, the window is removed from the plug body by explosive power generated by an ignition of the explosives, thereby forming a vent in the lifting plug, keeping combustion of a main charge and a supplementary charge even in the case when ignition thereof occurs, and thus preventing an explosion of the projectile.

2. The lifting plug of claim 1, wherein the explosives ignite at a temperature ranging from 150° C. and 160° C.

3. The lifting plug of claim 2, wherein the explosives have a weight ranging from 0.09 g and 0.18 g, and are pellet-shaped.

4. The lifting plug of claim 1, wherein the explosives comprise: 20 to 50 parts by weight of N-guanylurea dinitramide (GUDN); 30 to 60 parts by weight of 3-nitro-1,2,4-triazole-5-one (NTO); 10 to 20 parts by weight of potassium nitrate ($KNO_3$); 1 to 5 parts by weight of boron; and 0.5 to 1 parts by weight of diphenylamine.

5. The lifting plug of claim 4, wherein the explosives ignite at a temperature ranging from 150° C. and 160° C.

6. The lifting plug of claim 5, wherein the explosives have a weight ranging from 0.09 g and 0.18 g, and are pellet-shaped.

7. The lifting plug of claim 1, wherein the lifting plug is composed of an aluminum alloy composition comprising: 0.15% to 0.4% of Cu, 0.4% to 0.8% of Si, 0.7% of Fe, 0.15% of Mn, 0.8% to 1.2% of Mg, 0.25% of Zn, 0.04% to 0.35% of Cr, 0.15% of Ti, and a remainder of Al.

8. The lifting plug of claim 1, wherein the handle has a thickness ranging from 14 mm to 18 mm.

* * * * *